US009839075B1

(12) United States Patent
Sokryukin et al.

(10) Patent No.: US 9,839,075 B1
(45) Date of Patent: Dec. 5, 2017

(54) DOWNHOLE INDUCTION HEATER

(71) Applicants: Evgeny Sokryukin, Odintsovo (RU); Eduard Batyrbayev, Almaty (KZ)

(72) Inventors: Evgeny Sokryukin, Odintsovo (RU); Eduard Batyrbayev, Almaty (KZ)

( * ) Notice: Subject to any disclaimer, the term of this patent is extended or adjusted under 35 U.S.C. 154(b) by 4 days.

(21) Appl. No.: 15/231,027

(22) Filed: Aug. 8, 2016

(51) Int. Cl.

| | |
|---|---|
| ***E21B 36/04*** | (2006.01) |
| ***E21B 37/00*** | (2006.01) |
| ***H05B 6/06*** | (2006.01) |
| ***H05B 6/10*** | (2006.01) |
| ***H05B 6/38*** | (2006.01) |

(52) U.S. Cl.
CPC ..... *H05B 6/06* (2013.01); *E21B 36/04* (2013.01); *E21B 37/00* (2013.01); *H05B 6/105* (2013.01); *H05B 6/38* (2013.01)

(58) Field of Classification Search
CPC . H05B 6/06; H05B 6/105; H05B 6/36; H05B 6/38; E21B 36/04; E21B 37/00
USPC ..... 219/629, 630, 633, 635, 643, 644; 392/306
See application file for complete search history.

(56) References Cited

U.S. PATENT DOCUMENTS 2,757,739 A * 8/1956 Douglas ..... E21B 36/04 156/329
4,538,682 A * 9/1985 McManus ..... E21B 36/04 166/304

* cited by examiner

*Primary Examiner* — David L Andrews
*Assistant Examiner* — Yanick A Akaragwe
(74) *Attorney, Agent, or Firm* — Aleksandr Smushkovich

(57) ABSTRACT

An induction heater removing paraffin deposits from a drill pipe includes an inductor having an external coil heating up the deposits in the pipe, and an internal coil heating up a heating element transmitting heat to a rod, conducting heat to a tip melting the deposits surrounding thereof. The tip encloses a thermistor generating temperature feedback signals corresponding to its temperature, being operatively restricted. The inductor includes a capacitor battery series-connected with the coils forming an LC-circuit having a resonance frequency operatively subjected to changes. Electric current in LC-circuit is generated by an HF inverter, and measured by a current transformer generating current feedback signals. The temperature and current feedback signals are transmitted to a microprocessor executing a program controlling the inverter's frequency, providing a power-efficient operation mode of the heater. The proposed design of the coils and a connector, interconnecting the internal coil with the battery, reduces energy losses.

14 Claims, 8 Drawing Sheets

DOWNHOLE INDUCTION HEATER

FIELD OF THE INVENTION

The invention relates to the oil industry, in particular to induction heaters used in production wells of paraffinic, viscous and other oils for removal of paraffin deposits.

BACKGROUND OF THE INVENTION

There is known an induction heater (RF Patent 2086759), including a housing, a body and three separate induction coils (one for each phase) with three radiators. The cavity between the housing and the body is filled up with transformer oil. The disadvantages of this heater are the design complexity, inefficient way of using of eddy currents in conversion of the electric energy into heat and, accordingly, high power consumption.

The closest related art (analogue) to the present invention is an induction heater (RF Patent 2284407), comprising a housing, a bearing element disposed coaxially with the housing with series-connected induction coils placed on it and provided with ferrite magnetic cores.

Furthermore, the bearing element is made in the form of a conductive nonmagnetic rod, to the bottom of which an out coming round wire of the lower coil is attached. The upper part of the bearing element is shorted to a logging cable armor shell via a connector; the primary winding of an upper coil is connected to a central core of the cable (CCC) via a connector. The upper part of the housing is made of non-magnetic non-electrically-conductive material; the lower part of the housing is made of magnetic electrically conductive material, wherein the coil windings are wound on ferrite magnetic cores of different diameters, and the upper coil windings are wound on a ferrite magnetic core of a larger diameter, and the lower coil windings are wound on a ferrite magnetic core of a smaller diameter. Disadvantages of this heater are large power losses when operating at great depths, for instance, from 5000 meters or more, as well as a low output frequency of about 1 kHz, which reduce efficiency of the heater.

BRIEF SUMMARY OF THE INVENTION

The problem to be solved by the present invention is how to reduce losses of electric energy in power supply cables feeding downhole induction heaters and improve efficiency thereof.

The problem is solved and the sought result is achieved due to engineering solutions proposed herein, which are used in designing structural components of an inventive induction heater in conjunction with utilizing modern electronic components, in a limited space of a drilling pipe/oil production column determined by the width of the pipe/column.

As a result, the present invention allows for achieving: a reduction of losses of electric energy in power supply cables, when working at large downhole depths (5,000 m or more); and an increase of operating efficiency of the induction heater by controlling the output frequency of induction heating in a range of 60 to 200 kHz.

According to the present invention, there is proposed an induction heater being a component of an equipment complex for removal of paraffin deposits in drill pipelines/columns of production oil wells. The induction heater is electrically powered substantially from a standard power supply source. The induction heater is immersed into the drill pipeline.

The induction heater includes an inductor comprising: —an external induction coil disposed along a central longitudinal axis; the external induction coil includes a first external butt end; the external induction coil creates an external vortex magnetic field mostly heating up an inner surface of the drill pipe, thereby melting the paraffin deposits accumulated thereon; —an internal induction coil disposed along the central longitudinal axis; the internal induction coil includes a first internal butt end proximal to the first external butt end; the internal induction coil is nested inside the external induction coil; the internal induction coil creates an internal vortex magnetic field; —a contact bushing electrically connecting the first external butt end and the first internal butt end; the internal induction coil and the external induction coil, connected by the contact bushing, form a single two-layer induction coil; —a support rod mechanically securing the external induction coil and the internal induction coil; the support rod is capable of conducting heat; —a heating element converting energy substantially of the internal vortex magnetic field into heat; the heating element is tightly fitted onto the support rod and transfers heat thereto; and —a tip receiving heat from the heating element via the support rod; the tip accumulates heat and transfers heat mostly to the paraffin deposits accumulated inside the drill pipe and surrounding the tip thereby melting the paraffin deposits accumulated therein. This provides for heating the paraffin deposits from the inside (by the tip) and from the outside (by the inner surface of the drill pipe), which significantly accelerates the melting process.

In a preferred embodiment, the internal induction coil includes a second internal butt end located opposite to the first internal butt end; the internal induction coil further defines a spiral cutting, which forms an internal angle (preferably 72° 38') with the central longitudinal axis; the internal angle is determined so that the internal induction coil has N complete turns (preferably N=7); the internal induction coil further includes a number of apertures (preferably of a rectangular shape) provided at the second internal butt end; the apertures serve for connection of electric cables further passed through hollow passages passing through an attachment unit, and further connecting the internal induction coil substantially with a capacitor battery; and the external induction coil further defines a spiral cutting, which forms an external angle (preferably 101° 46') with the central longitudinal axis; and the external angle is determined so that the external induction coil has N+1 complete turns.

In a preferred embodiment, the induction heater includes: —a capacitor battery series-connected substantially with the internal induction coil and the external induction coil; the capacitor battery, the internal induction coil and the external induction coil substantially form an oscillatory LC-circuit; the capacitor battery includes a predetermined number of capacitors; —a transformer transmitting electric power into said oscillatory LC-circuit; and —a multiple-contact connector that (a) electrically connects in parallel the capacitors of the capacitor battery; (b) electrically connects the transformer with the capacitors of the capacitor battery; and (c) electrically connects the capacitors of the capacitor battery with the internal induction coil. Each capacitor has a number of leads; and the multiple-contact connector is made of a plurality of brass foil strips with a thickness of 0.2 mm and a width of 30 mm; the strips are furnished with a number of contact zones soldered to the leads of the capacitors; each strip is coated with an insulation layer made of high-temperature enamel, except for the contact zones; and the insulation layer individually covers each strip providing for electrical isolation between any two of the strips.

In a preferred embodiment, the induction heater includes: a thermistor disposed inside the tip; the thermistor measures a temperature the tip, and generates temperature feedback signals corresponding to the temperature of the tip; and electronic components, in particular: —the aforementioned capacitor battery, in conjunction with the external and internal coils forming an oscillatory LC-circuit with a resonant frequency; —a high-frequency inverter generating electric pulses characterized with a high frequency; the high-frequency inverter is powered substantially from the standard power supply source; —a high-frequency ferrite transformer receiving the electric pulses from the high-frequency inverter, transforming the electric pulses, and powering the oscillatory LC-circuit; —a current transformer measuring electric current flowing through the oscillatory LC-circuit, the current transformer generates current feedback signals corresponding to the electric current; —a unit of stabilizers providing low-voltage DC power supply; and —a microprocessor unit including a CPU and a memory pre-loaded with a control program; the microprocessor unit is powered from the unit of stabilizers; the microprocessor unit receives the temperature feedback signals and the current feedback signals; the control program, based on the temperature feedback signals and the current feedback signals, controls the high-frequency inverter essentially regulating the high frequency thereof, such that the high frequency becomes equal to the resonance frequency thereby providing a power-efficient mode of operation of the induction heater.

In a preferred embodiment, the internal induction coil is made of a copper-rolled tube; the external induction coil is made of a brass tube with a copper content not less than 62%; and the support rod is made of brass.

There is also proposed a method for control of the above-described induction heater comprising the steps of: —powering the microprocessor unit; —generating pulses of high frequency voltage by the microprocessor unit; —transmitting the pulses to the high frequency inverter; amplifying power of the pulses thereby converting the pulses into amplified pulses by the high frequency inverter; —applying the amplified pulses to the oscillatory LC-circuit; —measuring electric current in the oscillatory LC-circuit and generating current feedback signals by the current transformer; —transmitting the current feedback signals from the current transformer to the microprocessor unit; —scanning a predetermined work range of frequencies (preferably 80-200 kHz) by the control program, wherein the scanning starts with a maximum frequency of the predetermined work range and further reduces the frequency by a predetermined frequency step (preferably 300 Hz) within a predetermined time interval (preferably 2 seconds); based on the current feedback signals received by the microprocessor unit, determining amounts of electric current running in the oscillatory LC-circuit; —storing the amounts of electric current running in the oscillatory LC-circuit to the memory of the microprocessor unit; —after the scanning reaches a minimal frequency of the predetermined work range, processing the amounts of electric current stored in the memory; —determining a frequency at which the amount of electric current was maximal, wherein the frequency is equal to the resonant frequency; —continuing operation of the high frequency inverter at the resonant frequency within a predetermined pause time (preferably 10 minutes); and —restarting the scanning of the predetermined work range of frequencies by the control program.

The foregoing method may further comprise the additional steps of: —measuring a temperature of the tip and generating the temperature feedback signals corresponding to the temperature of the tip by the thermistor; —transmitting the temperature feedback signals from the thermistor to the microprocessor unit; when the temperature of the tip reaches a predetermined maximal temperature (preferably 105° C.), storing a corresponding value of the resonance frequency to the memory by the microprocessor unit, and further changing a frequency of the pulses of high frequency voltage by the microprocessor unit, so that an output power of the high frequency inverter is reduced by 50%; —when the temperature of the tip reaches the predetermined maximal temperature minus a predetermined hysteresis step (preferably 10° C.); and restoring the frequency of the pulses of high frequency voltage by the microprocessor unit to the corresponding value of the resonance frequency.

BRIEF DESCRIPTION OF DRAWINGS OF THE INVENTION

DETAIL DESCRIPTION OF PREFERRED EMBODIMENTS OF THE INVENTION

While the invention may be susceptible to embodiment in different forms, there are described in detail herein below, specific embodiments of the present invention, with the understanding that the instant disclosure is to be considered an exemplification of the principles of the invention, and is not intended to limit the invention to that as described herein.

An equipment complex for removal of paraffin deposits in production oil wells (specifically, in drilling pipes) includes an induction heater assembled of three modules coupled with each other, as explained below.

Figure 4:
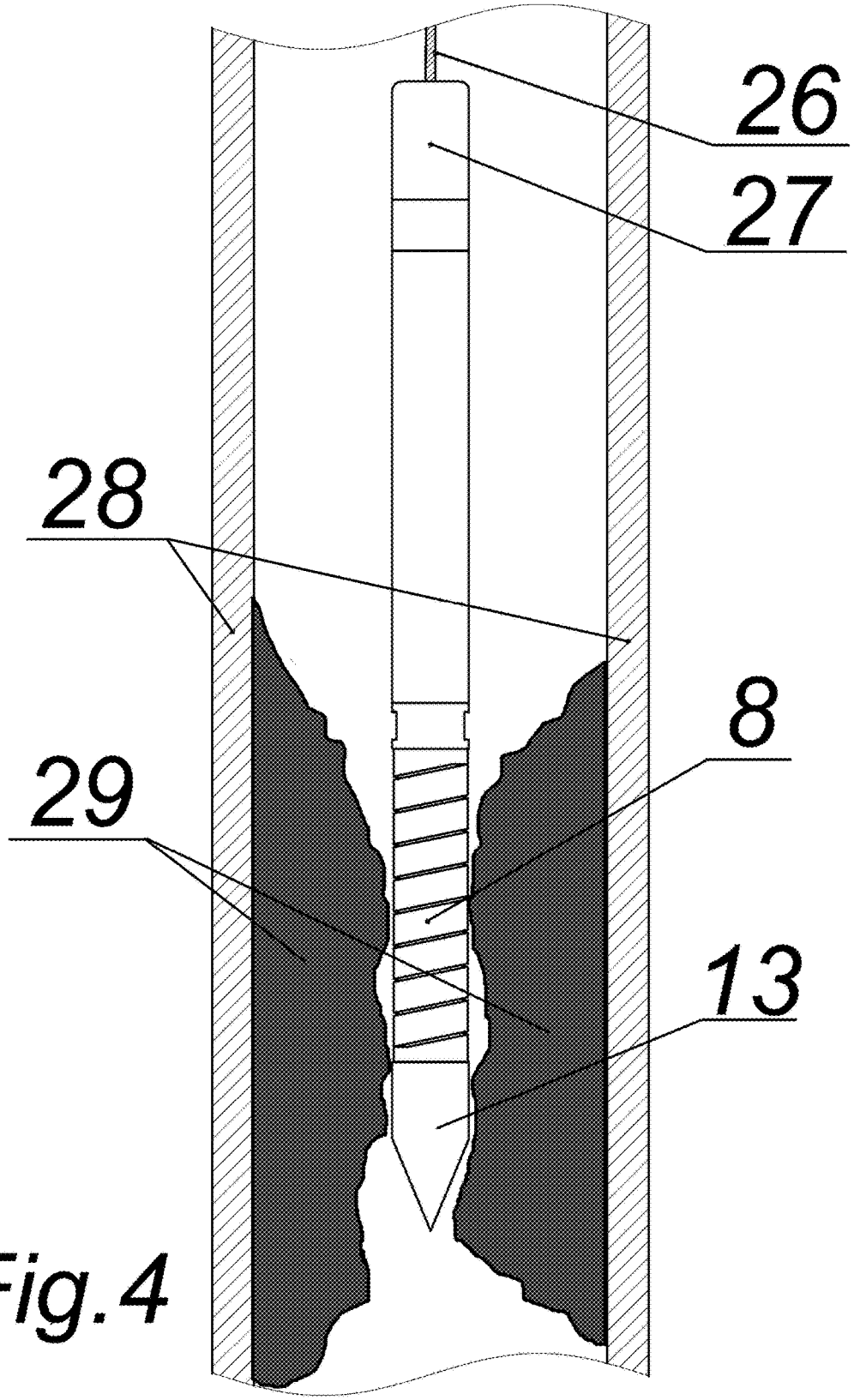
FIG. 4 illustrates a schematic view of the induction heater placed in a drill pipe clogged with paraffin deposits, according to a preferred embodiment of the present invention.

The induction heater (shown in FIG. 1) is composed of a head connector 1 (the first module), designed to electrically connect an inductor (numbered 3 in to a ground power supply source (numbered 31 in FIG. 5) by means of a power supply cable (numbered 26 in FIGS. 4, 5) through a cable head (numbered 27 in FIG. 4).

Figure 1:
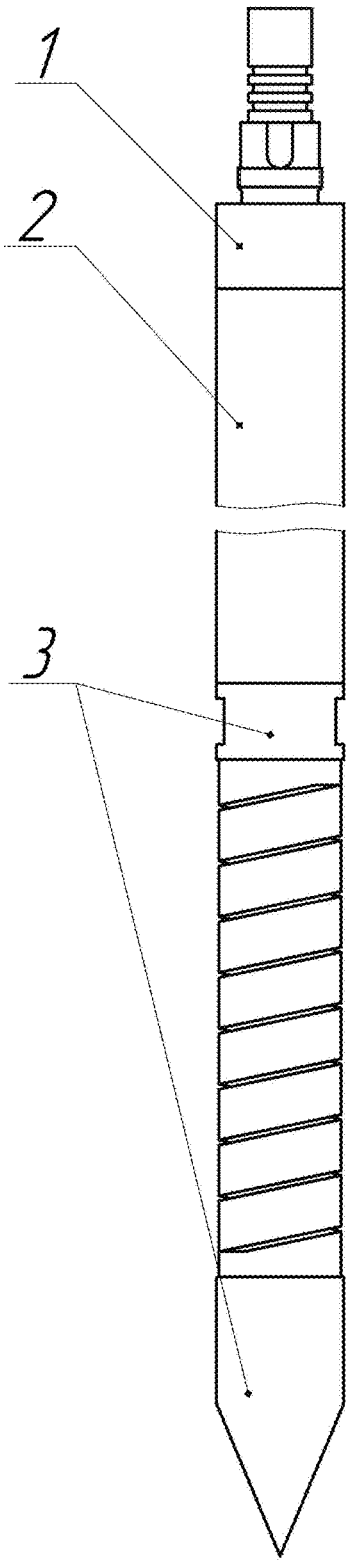
FIG. 1 illustrates a general view of an induction heater assembled of three major modules: an inductor coupled with a cylindrical housing (enclosing electronic control circuit components) further coupled with a head connector (serving for connection with a power supply cable electrically feeding the induction heater), according to a preferred embodiment of the present invention.
Figure 3:
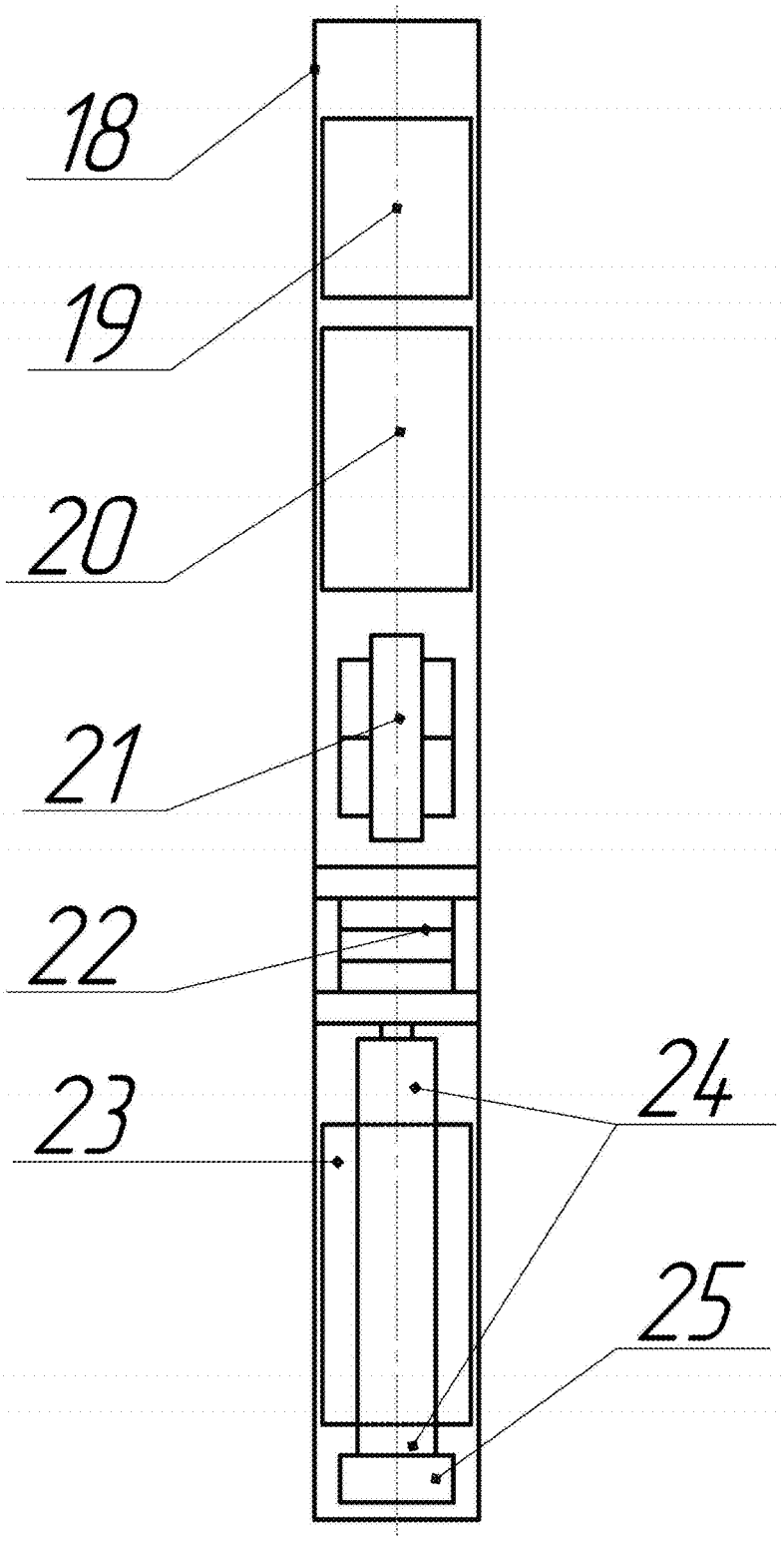
FIG. 3 illustrates a schematic view of the cylindrical housing with components enclosed therein, according to a preferred embodiment of the present invention.
Figure 5:
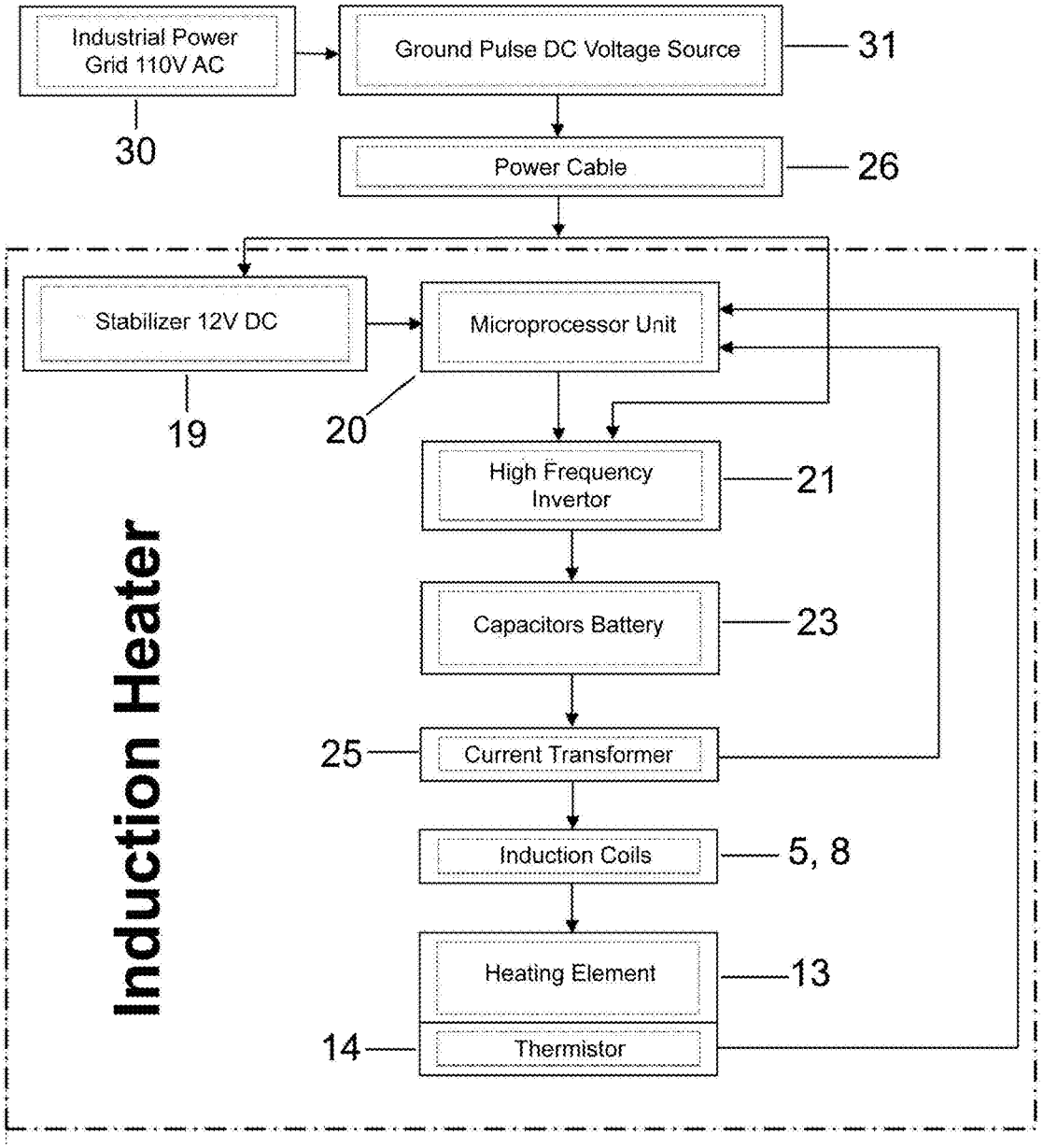
FIG. 5 illustrates a structural block-diagram of essential components of the induction heater connected by a power supply cable with a power supply source, according to a preferred embodiment of the present invention.
Figure 6:
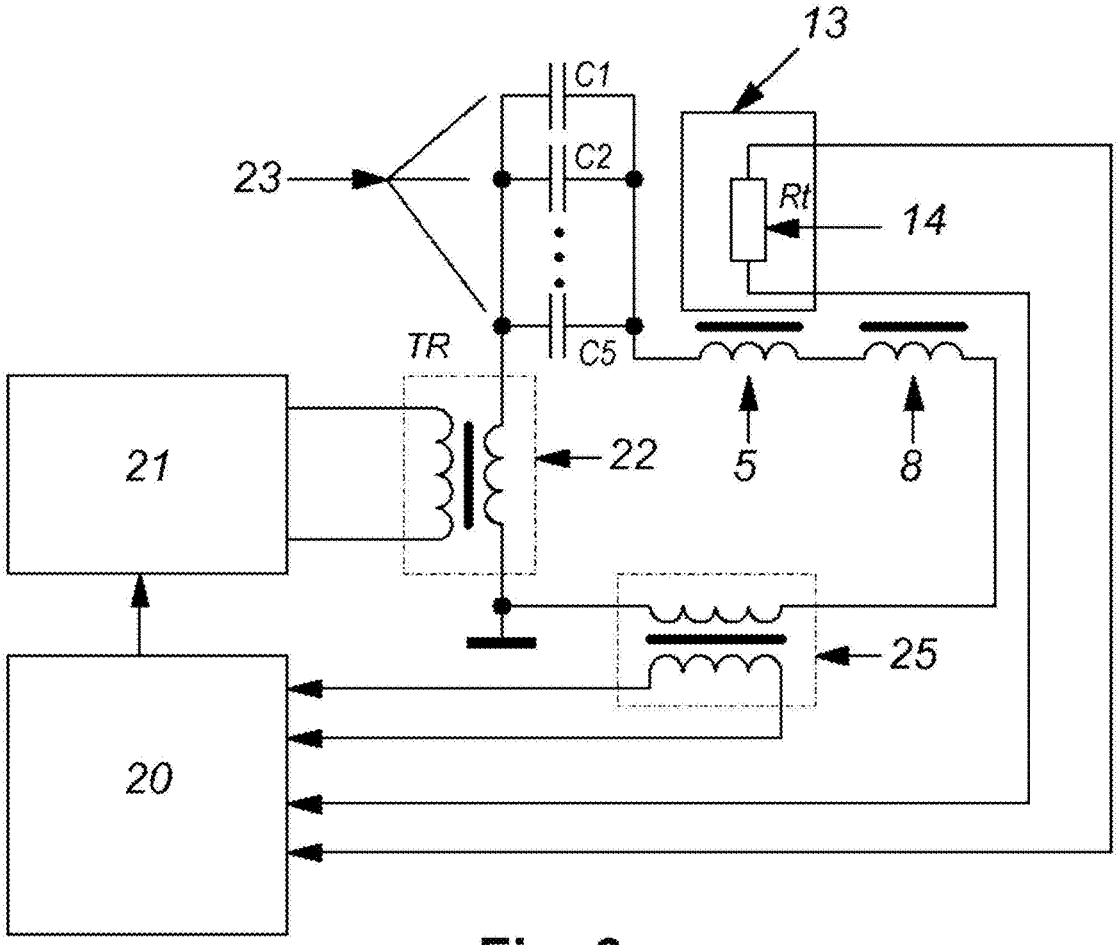
FIG. 6 illustrates an electric scheme of essential circuitry components for control of operation of the induction heater, according to a preferred embodiment of the present invention.

Yet, the induction heater (shown in FIG. 1) is composed of an electronic module (the second module), including a cylindrical housing 2 that encloses electronic control circuitry components (numbered 19-25 in FIGS. 3, 5, 6). The cylindrical housing 2 is designed to protect the electronic components from damage, when operating in aggressive environments, such as oil wells. The cylindrical housing 2 is attached to the head connector 1 (as shown in FIG. 1). The cylinder shape is considered more suitable for the housing, though another type of shape can be used in particular embodiments of the invention.

The induction heater (shown in FIG. 1) is also composed of an inductor 3 (shown in FIGS. 1, 2, 3, 5-8) (the third module) designed to create powerful vortex magnetic fields, whose energy is converted into heat, further used preferably to melt paraffin deposits in drilling pipes/columns. The inductor 3 is attached to the cylindrical housing 2 (as shown in FIG. 1).

Figure 2:
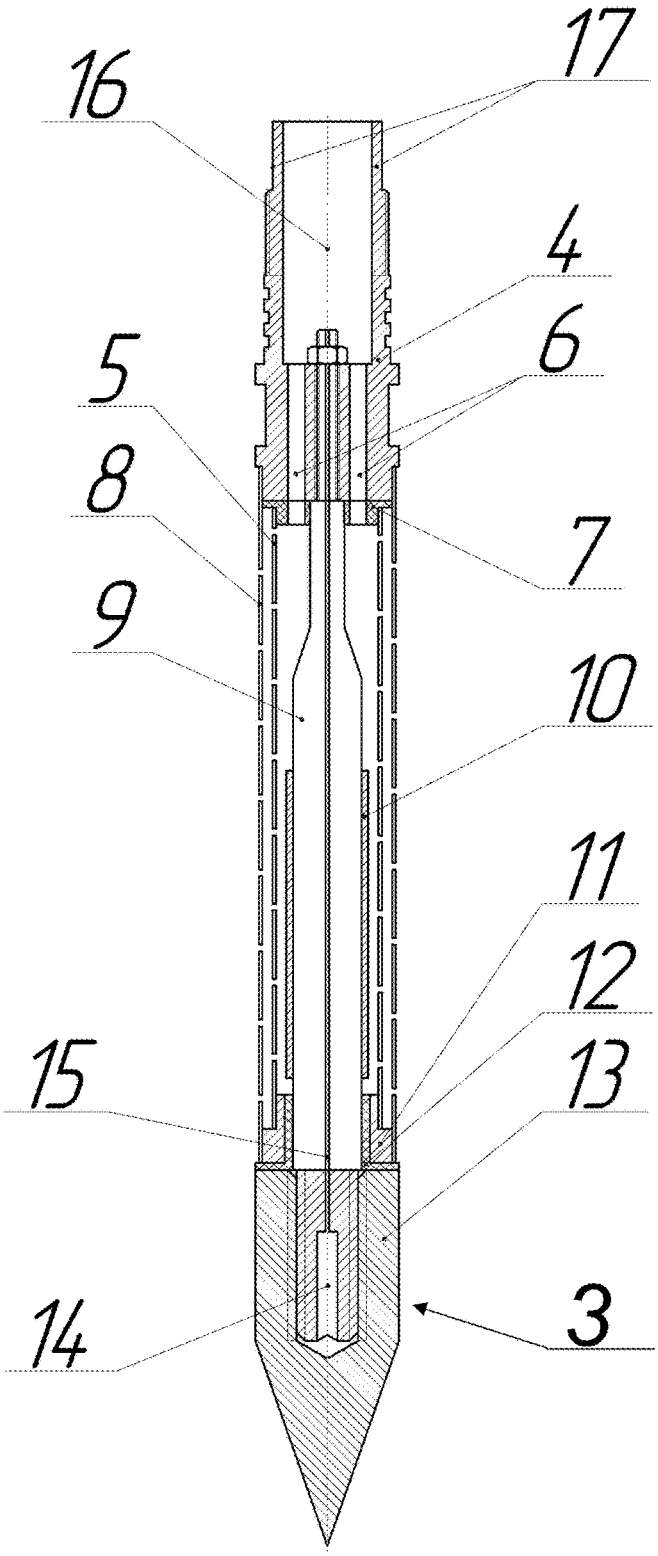
FIG. 2 illustrates a sectional view of the inductor with its components, according to a preferred embodiment of the present invention.
Figure 7:
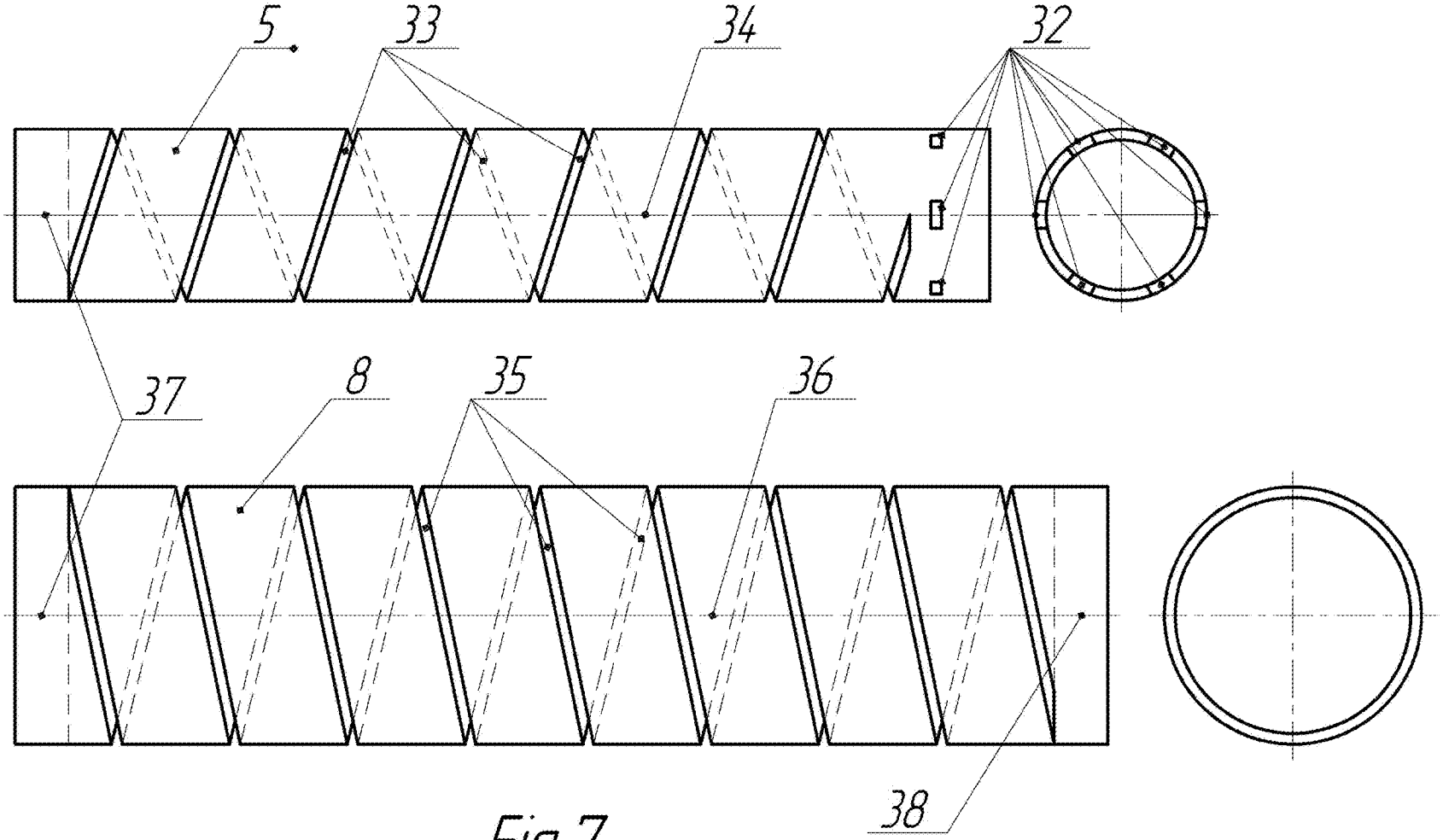
FIG. 7 illustrates frontal and lateral projections views of two induction coils, being major innovation components of the induction heater, according to a preferred embodiment of the present invention.
Figure 8:
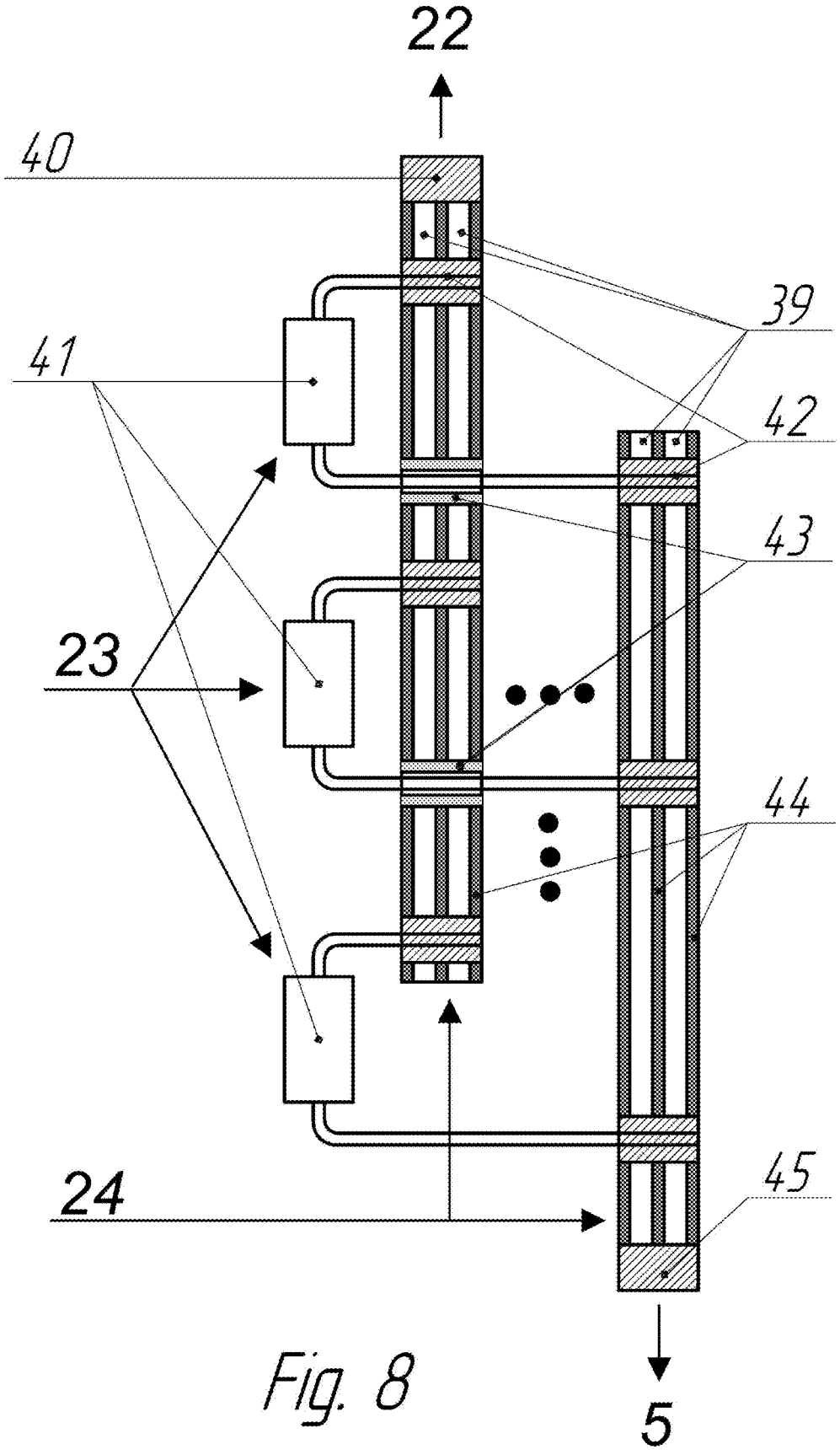
FIG. 8 illustrates a general view of a multiple connector, being another innovation component of the induction heater, according to a preferred embodiment of the present invention.

In turn, the inductor 3 comprises:

an attachment unit 4 (FIG. 2) providing for mechanical coupling of components of the induction heater 3, in particular, of a support rod (numbered 9 in FIG. 2), and for protection of the electronic control circuitry components (numbered 19-25 in FIGS. 3, 5, 6), disposed in the cylindrical housing 2 (FIG. 1), from exposure to strong magnetic fields, high temperature of heating elements of the inductor, and downhole environment aggressive factors, such as high hydraulic pressure and borehole fluid chemicals;

an internal induction coil 5 (FIG. 2), designed to generate vortex magnetic field. It is an innovative component of a resonant oscillatory LC-circuit (contour) used for frequency control of the inductor 3. In detail, design of the coil 5 is shown in FIG. 7 and described below;

hollow passages 6 (FIG. 2) passing through the attachment unit 4. The hollow passages 6 serve for passing cables of electrical connection of the internal induction coil 5 with electronic circuits (explained herein below in detail) arranged inside the cylindrical housing 2 (FIG. 1);

an upper insulating bushing 7 (Fi designed to electrically isolate the internal induction coil 5 from short circuiting to the attachment unit 4;

an external inductive coil 8 (FIG. 2), designed to generate vortex magnetic field. It is also an innovative component of the resonant oscillatory LC-circuit used for frequency control of the inductor 3. Design of the coil 8 is shown in FIG. 7. The coils 5 is nested inside the coil 8, whereas each of the coils preferably has its own precisely calculated angle of spiral cutting, which is a novel design feature of inductor coils. Connection of the induction coils, produced in such way, makes them a single bi-layer coil (FIG. 7). Connection of the coils 5 and 8 is shown in FIG. 2 and FIG. 6. In detail, design of the coil 8 is described below;

a support rod 9 designed for mechanical attachment and support o the internal coil 5 and the external coil 8. The support rod 9 also serves as an intermediate component for heat conduction from a heating element (numbered 10 in FIG. 2) to a tip (numbered 13 in FIG. 2). The support rod is preferably made of brass and has a substantial thermal conductivity that allows thermal energy to be effectively supplied into the tip;

a heating element 10 (FIG. 2), designed to convert energy of the vortex magnetic field into heat. It's tightly fitted onto the support rod 9 (FIG. 2);

a contact bushing 11 (FIG. 2), designed to provide electrical connection of the internal induction coil 5 and the external induction coil 8;

a lower insulating bushing 12 (FIG. 2), designed to electrically isolate the connection of the induction coils 5 and 8 against short-circuiting them to the support rod 9 and hence to the cylindrical housing 2;

a tip 13 (FIG. 2) designed for accumulation of heat energy received through the support rod 9 from the heating element 10 and for transfer of the heat energy into external environment, e.g. melting paraffin deposits from the inside;

a thermistor 14 (FIG. 2) used for temperature control of the tip 13;

a cable channel 15 of the thermistor 14 (FIG. 2), through which feedback signals from the thermistor 14 are transmitted to the electronic control circuit components (shown in FIG. 5) disposed in the cylindrical housing 2 (FIG. 1);

a buffer cylinder 16 (FIG. 2), designed for casting (introduction) of a high temperature compound with a significant adhesion to metals. Thereby it prevents penetration of drilling mud through the hollow passages 6 (FIG. 2) to the electronic control circuitry;

an attachment sleeve 17 (FIG. 2) for coupling with a semi-cylindrical brass container (numbered 18 in FIG. 3), enclosing the electronic control circuitry components (numbered 19-25 in FIGS. 3, 5, 6);

FIGS. 3, 5 and 6 show an electronic module (the third module) of the induction heater, wherein the electronic module comprises:

a semi-cylindrical brass container 18 designed for mechanical mounting of the electronic control circuitry components (numbered 19-25 in FIGS. 3, 5, 6). In addition, it serves as a passive heatsink cooling power elements of a high-frequency inverter (numbered 21 in FIGS. 3, 5, 6). The semi-cylinder shape is considered more suitable for the container 18, though another type of shape can be used in particular embodiments of the invention. The semi-cylindrical brass container 18 is located inside the cylindrical housing 2. A preferable width of cross-section of the container 18 is 38 millimeters;

a unit of stabilizers 19 (also herein called a 'secondary pulse power supply'), designed for power supply of low-voltage DC electronic circuits of a microprocessor unit (numbered 20 in FIGS. 3, 5, 6). Since the constant voltage fed directly through a power supply cable (numbered 26 in FIGS. 4, 5) is excessive to power the microprocessor unit, the unit 19 converts voltage received from a ground power source (numbered 31 in FIG. 5) to DC voltage of 12 V;

a microprocessor unit 20 (FIGS. 3, 5, 6) controls operation of the induction heater. The microprocessor unit 20 (FIG. 5) comprises a CPU and an internal non-volatile memory for loading a control program, which program, during its execution, controls operation of the inductor 3.

a high-frequency inverter 21 (FIGS. 3, 5, 6), designed to generate high power electric pulses. The unit 21 is powered by the ground power source (numbered 31 in FIG. 5) via the power cable (numbered 26 in FIG. 4);

a high-frequency ferrite transformer 22 (FIGS. 3, 6). Together with the high-frequency inverter 21, it is designed for generating and transmitting energy into a resonant oscillatory LC-circuit (also known as an LC-contour) formed by a capacitor battery (numbered 23 in FIGS. 3, 5, 6) and the induction coils 5 and 8 (FIG. 6);

a capacitor battery 23 (FIGS. 3, 5, 6.) being a major component of the resonant oscillatory LC-circuit. The capacitor battery 23 includes a predetermined number of capacitors (numbered 41 in FIG. 8), each with a predetermined capacitance. The capacitor battery 23 is series-connected substantially with the induction coils 5 and 8 thereby forming the resonant oscillatory LC-circuit;

a multiple-contact connector 24 (FIGS. 3, 8), designed to electrically connect the high frequency transformer 22, the capacitor battery 23, and the inductive coil 5 and the high-frequency ferrite transformer 22 (see FIGS. 6 and 8). Design of the multiple-contact connector (FIG. 8) is a novel feature in induction heaters. In detail, the design of multiple-contact connector 24 is described below;

a current transformer 25 (FIGS. 3, 5, 6) designed to measure the electric current flowing through the LC-circuit formed by the capacitor battery 23 and the induction coils 5 and 8 (see FIG. 6).

The equipment complex is preferably powered from a standard electric power supply source, such as an industrial electric power grid 30 (FIG. 5). The standard electric power supply source is preferably located on the earth surface.

The equipment complex also includes: a power supply cable 26 (also known as 'geo-physical cable', or 'logging cable') (FIGS. 4, 5) used for power transmission from the ground-based pulse power supply (numbered 31 in FIG. 5); a cable head 27 (FIG. 4) that connects the power supply cable 26 with the induction heater 3; a drill pipe (also called a 'downhole pipe', or a 'well pipe') 28 (FIG. 4) used in oil production; a paraffin deposits clot 29 (FIG. 4) often accumulated in the drill pipe 28; a ground-based pulse DC power supply unit 31 (FIG. 5) converting AC voltage of the industrial grid 30 into DC voltage.

A best design mode of the internal induction coil 5 is depicted in FIG. 7. The internal induction coil 5 has a spiral cutting 33 which forms an angle of 72° 38' with an axis 34 being a central longitudinal axis of the coil 5. The angle is calculated so that the internal induction coil 5 has seven complete turns. At the right end of the internal induction coil 5, there are provided six rectangular apertures 32 for cable electrical connections of the coil 5 with the capacitor battery 23. The connection is made by six electric cables passed through the hollow passages 6 (FIG. 2) of the attachment unit 4 (FIG. 2).

FIG. 7 also shows a best design mode of the external induction coil 8 having a spiral cutting 35 that forms an angle of 101° 46' with an axis 36 being a central longitudinal axis of the coil 8. The angle is calculated so that the external induction coil 8 has eight full turns.

Yet, FIG. 7 shows an area of electrical connection 37 of the internal induction coil 5 and the external induction coil 8 via the contact bushing 11 (FIG. 2) and the formation of a single two-layer induction coil that together with the capacitor battery 23 form the resonant LC-circuit (FIG. 6).

In addition, FIG. 7 shows a zone of electrical connection 38 of the external induction coil 8 with the attachment unit 4. The connection is made over the top of the upper insulating bushing 7 (FIG. 2).

The internal induction coil 5 is preferably made of a copper-rolled tube in which the spiral cutting is made at a pre-calculated angle so that it provides for forming a spiral of eight turns (FIG. 7).

The external coil 8 is preferably made of a brass tube with a copper content not less than 62%. Connected together through the contact bushing 11 (FIG. 2), the internal coil 5 and the external coil 8 form a single two-layer induction coil (the connection circuit of the coils 5 and 8 is shown in FIG. 6).

Vortex magnetic field of the internal coil 5 (FIG. 2) effectively heats up the heating element 10 tightly fitted onto the support rod 9. The support rod 9 is preferably made of brass, and has a substantial thermal conductivity' that allows for thermal energy to be effectively supplied into the tip 13 (FIG. 2) being in direct contact with a paraffin deposit clot 29 on an inner surface of the drill pipe 28 and effectively melts the clot from inside thereof. Melted paraffin is removed by a flow of drilling fluid.

It was experimentally found that heating up of paraffin deposits to a temperature above 115° C. might lead to caking of solids present in the deposits into a hardly removable substance.

In order to prevent this situation, the thermistor 14 is fitted at the end of the support rod 9 (FIG. 2, 5). When the temperature of the tip 13 (FIG. 2) reaches 105° C., the microprocessor unit 20 stores a resonance frequency value to the memory (RAM), and further changes the frequency of oscillations of the high frequency inverter so that its power output would be reduced by 50%.

Hysteresis of temperature adjustment is 10° C. That is, when temperature of the tip decreases down to 95° C., the microprocessor restores the resonance frequency and the induction heater 3 continues working at its maximum power.

During the operation, because of heating up the capacitor battery 23, the battery's electrical capacitance is changing (effectively changing the C-component of the oscillating LC-circuit), and consequently, the resonance frequency of the LC-circuitry changes as well. For this reason, re-search (re-scanning) of the changed resonance frequency is required.

The control program performs such search for every 10 minutes of operation of the induction heater.

Experiments have shown that frequency changes are insignificant, but nonetheless they can significantly affect the thermal mode of operation of the high-frequency inverter, causing excessive heating of its power elements and thus increasing energy losses.

A somewhat different function is performed by the external induction coil 8 (FIG. 4). Its vortex magnetic field effectively heats up metal of the drill pipe 28, the inner surface of which has the paraffin deposit clot 29 formed thereon. Thusly, it heats up the paraffin deposit clot 29 from outside of the paraffin deposit clot.

As a result, the melting of paraffin takes place both inside and outside of the paraffin clot. Due to elimination of paraffin deposits in oil wells, the time and costs spent for the drill works are reduced, which improves the overall performance of the equipment complex with the inventive induction heater.

For comparative analysis of operation efficiency of the induction heater, it should be taken into account that the time spent on cleaning of one well from paraffin, using the induction heater, does not exceed 3-4 hours, whereas traditional methods for mechanical removal of paraffin deposits may require a few days.

FIG. 8 shows a portion of a longitudinal cross-section view of the multiple-contact connector 24 (FIG. 3). The multiple-contact connector 24 is designed to provide:

a) parallel connection of capacitors 41 being parts of the capacitor battery 23 (FIG. 8);
b) connections of the capacitor battery 23 with the high frequency ferrite transformer 22 (FIGS. 5 and 8) on one side;
c) connections of the capacitor battery 23 to the internal induction coil 5 (FIGS. 5 and 8) on the other side.

The multiple-contact connector 24 is preferably made of twelve strips 39 manufactured from brass (FIG. 8) with a thickness of 0.2 mm and a width of 30 mm. The strips 39 are furnished with contact zones 42 and dielectric sleeves 43. Each such strip is coated with an insulation layer 44 of high-temperature varnish (FIG. 8), except for the contact zones 42, which are soldered to leads of the capacitors 41. The high-temperature enamel individually covers each strip providing for electrical isolation between any two of aforesaid strips. This is necessary to avoid a negative influence of the skin effect on the performance of the induction heater.

The capacitor leads are passed through a number of orifices made in the multiple-contact connector 24. Those orifices, where the capacitor leads must not contact the material of multiple-contact connector 24, are isolated by the dielectric sleeves 43 (FIG. 8).

Connections with the high frequency ferrite transformer 22 (FIG. 5) are arranged in a zone 40 (FIG. 8). Connections to the induction coil 5 (FIG. 5) are arranged in a zone 45 (FIG. 8).

For clarity, FIG. 8 shows only four of the twelve brass strips 39 and only three of the five capacitors 41 of the capacitor battery 23.

The multiple-contact connector 24 is preferably formed of brass foil with a predetermined thickness. The thickness is predetermined such that it provides for full compensation for energy losses caused by the skin effect. The connector 24 is preferably formed of 12 foil strips, each coated with a protective layer of a high-temperature enamel.

Thus, the effective cross-section of the multiple-contact connector 24 provides for electric current flowing through the LC-circuit with almost no loss, and with minimal dimensions of the connector 24. The minimal dimensions of the connector are an important feature of the invention, since they are limited by the size of semi-cylindrical container 18 (enclosing the electronic circuits components) (FIG. 3). As disclosed hereinabove, a preferable width of cross-section of the container 18 is 38 millimeters.

Operation of a Preferred Embodiment of the Invention

The induction heater works as follows. The ground DC power supply unit 31, by, means of the power supply cable 26 and the cable head 27, electrically feeds most of the electronic components, contained in the cylindrical housing 2, and the power components of the inductor 3.

When the microprocessor unit 20 is powered and starts working, its control program (loaded into the internal non-volatile memory of the unit 20) begins searching for the resonant frequency of the LC-circuit. Pulses of high frequency voltage are generated by the microprocessor unit 20 and supplied to the high frequency inverter 21 which amplifies power of the pulses. Next, the voltage pulses, transmitted by the high-voltage transformer 22, are applied to the series LC-circuit (FIG. 5).

It is known that full resistance of a series LC-circuit at resonance is minimal and therefore, electric current flowing through the circuit reaches its maximum. Therefore, tuning of the series LC-circuit into resonance is provided by searching for a frequency at which the current in the LC-circuit is maximized.

In the induction heater, electric current in the LC-circuit is measured by the current transformer 25 (FIGS. 3, 5, 6), and measurement signals from the transformer 25 are transmitted to the microprocessor 20 as feedback.

The control program scans a work range of frequencies (80-200 kHz) in order to find the maximal current value of the LC-circuit. The choice of this work frequency range is conditioned by preliminary calculations of parameters of the LC-circuit essentially for all feasible design options of the inventive induction heater. These design options account for changes of dimensions of the inductor and the induction heater as a whole, for carrying out induction heating of the drill pipes 28 of various known diameters.

The control program starts searching with the frequency of 200 kHz. A step of changing the frequency is 300 Hz. By reducing the signal in each frequency step, the microprocessor 20, within 2 seconds, measures the amount of electric current flowing through the LC-circuit. The current amounts are stored into the microprocessor's memory in the form a data array. After reaching the lower limit of 80 kHz, the program proceeds to processing the data array recorded and determines the frequency at which the LC-circuit current was maximal, i.e. the resonant frequency. After determining the resonant frequency, the high-frequency inverter 21 keeps operating at its maximum power.

Electric currents running in the LC-circuit at resonance can reach several hundred amperes. This imposes high demands upon the design of electrical connections of the capacitor battery and the induction coils of the inductor. These connections are described hereinabove.

Skin effect becomes very significant at high resonance frequencies, and the effect is manifested in displacement of electrical conduction currents from the internal areas of the conductor into the external ones. Along with this, the active resistance of cables (providing electrical connections of the LC-circuit's components) increases.

The result is significant losses of power consumed for heating the cables, which dramatically decreases efficiency of operation of the device and makes it worthless. The problem was resolved in the present invention by using the specially designed multiple-contact connector 24 described above (FIG. 8).

Another important feature of the induction heater is the design of the induction coils 5 and 8 described hereinabove (FIG. 2, 7).

OPTIONS OF INDUSTRIAL APPLICABILITY

The inventive induction heater has a number of other useful properties. It is known that high mechanical loads operatively applied to the well pipes' material can result in noticeable magnetization of some segments of the pipes. At the same time, drilling fluid is not an electrically neutral liquid and it has an ionic composition due to dissociation of salt molecules dissolved in the drilling solution (also called drilling mud). In other words, the drilling fluid is essentially electrolyte.

Movement of the electrolyte transporting electric charges across the magnetic fields of the magnetized sections of the well pipe causes a small potential difference in diametrically opposite points of the pipe.

This process is known in physics as the magnetic hydrodynamic effect. Among other reasons, this potential difference increases the corrosion rate of the well pipe, which over time makes it inoperable without costly repairs. Powerful high-frequency field of the induction heater is capable of eliminating the magnetization of well pipes, thus extending their operation lifespan.

Another option of use of the induction heater is the warming up of a perforation zone in production oil wells in order to remove tar impurities that reduce the efficiency of oil inflow.

We claim:

1. An induction heater for removal of a paraffin deposit clot accumulated inside of a drill pipe of an oil well; said drill pipe has an inner surface; said induction heater is immersed into the drill pipe; said induction heater is electrically powered substantially from a power supply source; said induction heater defines a central longitudinal axis; said induction heater includes an inductor comprising:

an external induction coil disposed along the central longitudinal axis; said external induction coil includes a first external butt end; said external induction coil creates an external vortex magnetic field heating up substantially said inner surface of the drill pipe, thereby melting the paraffin deposit clot from outside thereof;

an internal induction coil disposed along the central longitudinal axis; said internal induction coil includes a first internal butt end proximal to said first external butt end; said internal induction coil is nested inside the external induction coil; said internal induction coil creates an internal vortex magnetic field;

a contact bushing electrically connecting said first external butt end and said first internal butt end; the internal induction coil and the external induction coil, connected by said contact bushing, form a single two-layer induction coil;

a support rod mechanically securing the external induction coil and the internal induction coil;

said support rod is capable of conducting heat;

a heating element converting energy substantially of the internal vortex magnetic field into heat; said heating element is tightly fitted onto the support rod and transfers heat thereto; and a tip receiving heat from the heating element via the support rod; said tip accumulates heat and transfers heat to the paraffin deposit clot thereby melting the paraffin deposit clot from inside thereof.

2. The induction heater according to claim 1, further including a capacitor battery series-connected substantially with the internal induction coil and the external induction coil; wherein:

said inductor further comprises:

an attachment unit providing for securing at least the support rod;

hollow passages passing through the attachment unit;

and wherein:

said internal induction coil includes a second internal butt end located opposite to said first internal butt end; the internal induction coil further defines a spiral cutting, which forms an internal angle with said central longitudinal axis; the internal angle is determined so that the internal induction coil has N complete turns, wherein N is an integer number; the internal induction coil further includes a number of apertures provided at the second internal butt end the apertures serve for connection of electric cables further passed through the hollow passages, and further connecting the internal induction coil substantially with the capacitor battery; and the external induction coil further defines a spiral cutting, which forms an external angle with said central longitudinal axis; the external angle is determined so that the external induction coil has N+1 complete turns.

3. The induction heater according to claim 2, wherein:

N=7; said internal angle is 72° 38'; said external angle is 101° 46';

the internal induction coil is made of a copper-rolled tube;

the external induction coil is made of a brass tube with a copper content not less than 62%; and the support rod is made of brass.

4. The induction heater according to claim 1, further including:

a capacitor battery series-connected substantially with the internal induction coil and the external induction coil; said capacitor battery, the internal induction coil and the external induction coil substantially form an oscillatory LC-circuit; said capacitor battery includes a predetermined number of capacitors;

a transformer transmitting electric power into said oscillatory LC-circuit; and a multiple-contact connector (a) electrically connecting in parallel said capacitors of the capacitor battery; (b) electrically connecting said transformer with said capacitors of the capacitor battery; and (c) electrically connecting said capacitors of the capacitor battery with said internal induction coil.

5. The induction heater according to claim 4, wherein:

each said capacitor has a number of leads; and said multiple-contact connector is made of a plurality of brass foil strips with a thickness of 0.2 mm and a width of 30 mm; the strips are furnished with a number of contact zones soldered to said leads of the capacitors; each said strip is coated with an insulation layer made of high-temperature enamel, except for the contact zones; the insulation layer individually covers each said strip providing for electrical isolation between any two of said strips.

6. The induction heater according to claim 1, wherein:

said inductor further includes a thermistor disposed inside said tip; said thermistor measures a temperature of the tip, and generates temperature feedback signals corresponding to the temperature of the tip;

said induction heater further comprises a housing assembled with said inductor; said housing contains a container enclosing at least the following electronic components:

a capacitor battery characterized with a battery capacitance subjected to changes caused at least by operatively heating up the capacitor battery; said capacitor battery is series-connected substantially with the internal induction coil and the external induction coil, substantially forming an oscillatory LC-circuit characterized with a resonance frequency, in particular depending upon said battery capacitance;

a high-frequency inverter generating electric pulses characterized with a high frequency; said high-frequency inverter is powered substantially from said power supply source;

a high-frequency ferrite transformer receiving said electric pulses from said high-frequency inverter, transforming said electric pulses, thereby powering said oscillatory LC-circuit;

a current transformer measuring electric current flowing through the oscillatory LC-circuit, said current transformer generating current feedback signals corresponding to said electric current;

a unit of stabilizers providing low-voltage DC power supply; and a microprocessor unit including a CPU and a memory pre-loaded with a control program executable by the microprocessor unit; said microprocessor unit is powered from said unit of stabilizers; said microprocessor unit receives said temperature feedback signals and said current feedback signals; said control program, when executed by the microprocessor, based on said temperature feedback signals and said current feedback signals, controls the high-frequency inverter essentially regulating said high frequency thereof, such that the high frequency becomes equal to said resonance frequency thereby providing a power-efficient mode of operation of the induction heater.

7. The induction heater according to claim 6, wherein said capacitor battery includes a predetermined number of capacitors; and said electronic components further include:

a multiple-contact connector (a) electrically connecting in parallel said capacitors of the capacitor battery; (b) electrically connecting said high-frequency ferrite transformer with said capacitors of the capacitor battery; and (c) electrically connecting said capacitors of the capacitor battery with said internal induction coil.

8. The induction heater according to claim 7, wherein:

each said capacitor has a number of leads; and said multiple-contact connector is made of a plurality brass foil strips with a thickness of 0.2 mm and a width of 30 mm; the strips are furnished with a number of contact zones soldered to said leads of the capacitors; each said strip is coated with an insulation layer made of high-temperature enamel, except for the contact zones; the insulation layer individually covers each said strip providing for electrical isolation between any two of said strips.

9. The induction heater according to claim 6, wherein:

said inductor further comprises:

an attachment unit providing for securing at least the support rod;

hollow passages passing through the attachment unit;

said internal induction coil includes a second internal butt end located opposite to said first internal butt end; the internal induction coil further defines a spiral cutting, which forms an internal angle with said central longitudinal axis; the internal angle is determined so that the internal induction coil has N complete turns, wherein N is an integer number; the internal induction coil further includes a number of rectangular apertures provided at the second internal butt end; the apertures serve for connection of electric cables further passed through the hollow passages, and further connecting the internal induction coil substantially with the capacitor battery; and the external induction coil further defines a spiral cutting, which forms an external angle with said central longitudinal axis; the external angle is determined so that the external induction coil has N+1 complete turns.

10. The induction heater according to claim 9, wherein:

N=7; said internal angle is 72° 38'; said external angle is 101° 46';

the internal induction coil is made of a copper-rolled tube;

the external induction coil is made of a brass tube with a copper content not less than 62%; and the support rod is made of brass.

11. A method for control of the induction heater according to claim 6, comprising the steps of:

powering the microprocessor unit;

generating pulses of high frequency voltage by the microprocessor unit;

transmitting said pulses to the high frequency inverter;

amplifying power of said pulses thereby converting said pulses into amplified pulses by the high frequency inverter;

applying said amplified pulses to the oscillatory LC-circuit;

measuring electric current in the oscillatory LC-circuit and generating current feedback signals by the current transformer corresponding to said electric current;

transmitting the current feedback signals from the current transformer to the microprocessor unit;

scanning a predetermined work range of frequencies by the control program, executed by the microprocessor unit, wherein the scanning starts with a maximum frequency of said predetermined work range and further reduces the frequency by a predetermined frequency step within a predetermined time interval;

based on the current feedback signals received by the microprocessor unit, determining amounts of the electric current running in the oscillatory LC-circuit;

storing said amounts of the electric current to the memory of said microprocessor unit;

after the scanning reaches a minimal frequency of said predetermined work range, processing said amounts of the electric current stored in the memory;

determining a frequency at which said amount of the electric current was maximal, wherein the frequency is equal to said resonant frequency;

continuing operation of the high frequency inverter at said resonant frequency within a predetermined pause time; and restarting said scanning of the predetermined work range of frequencies by the control program.

12. The method according to claim 11, wherein said predetermined work range of frequencies is 80-200 kHz; said predetermined frequency step is 300 Hz; said predetermined time interval is 2 seconds; and said predetermined pause time is 10 minutes.

13. The method according to claim 11, further comprising the steps of:

measuring a temperature of the tip and generating the temperature feedback signals corresponding to said temperature of the tip by said thermistor;

transmitting the temperature feedback signals from the thermistor to the microprocessor unit;

when the temperature of said tip reaches a predetermined maximal temperature, storing a corresponding value of said resonance frequency to the memory by said microprocessor unit, and further changing a frequency of said pulses of high frequency voltage by said microprocessor unit, so that a power output of the high frequency inverter is reduced by 50%; and when the temperature of said tip reaches the predetermined maximal temperature minus a predetermined hysteresis step, restoring the frequency of said pulses of high frequency voltage by said microprocessor unit to the corresponding value of said resonance frequency.

14. The method according to claim 13, wherein the predetermined maximal temperature is 105° C.; and said predetermined hysteresis step is 10° C.

* * * * *